US005664727A

United States Patent [19]

Beall

[11] Patent Number: 5,664,727

[45] Date of Patent: Sep. 9, 1997

[54] PORTABLE CARTRIDGE BRASS COLLECTOR

[76] Inventor: John Ninian Beall, 27 Riverknoll Dr., Asheville, N.C. 28805

[21] Appl. No.: 638,699

[22] Filed: Apr. 26, 1996

[51] Int. Cl.[6] ..... B65D 91/00

[52] U.S. Cl. ..... 232/1 R; 220/6; 206/317

[58] Field of Search ..... 232/1 R; 220/6; 206/317

[56] References Cited

U.S. PATENT DOCUMENTS

| | | | |
|---|---|---|---|
| 2,354,277 | 7/1944 | Richardson | 42/98 |
| 3,009,565 | 11/1961 | Leone | 206/317 X |
| 3,031,069 | 4/1962 | Hirsch | 206/317 |
| 3,658,241 | 4/1972 | Pistocchi | 232/1 R |
| 3,744,623 | 7/1973 | Woofter | 220/6 X |
| 4,028,834 | 6/1977 | Dobson | 42/98 |
| 4,110,927 | 9/1978 | Morris | 42/98 |
| 4,296,565 | 10/1981 | Jaffin et al. | 42/98 |
| 4,959,918 | 10/1990 | Perez | 42/98 |

*Primary Examiner*—Jerry Redman
*Attorney, Agent, or Firm*—Carter & Schnedler

[57] ABSTRACT

There is provided a free-standing portable cartridge brass collector which includes a container having two side walls, a rear wall, a top wall, a bottom wall and an open end. The top wall includes an overhang portion defining a firing space for a brass ejecting weapon. A baffle is received within the container for segregating the inside of the container into two sections. The top wall guides the ejected brass into one of the sections within the container as determined by the baffle.

10 Claims, 5 Drawing Sheets

PORTABLE CARTRIDGE BRASS COLLECTOR

BACKGROUND OF THE INVENTION

This invention relates to apparatus used on firing ranges. More particularly, it relates to apparatus for conveniently collecting ejected cartridge brass after a weapon has been fired.

During target shooting brass casings are ejected from automatic pistols often some fifteen to twenty feet from the pistol. Because brass is rather expensive, target shooters usually retrieve the spent brass for reloading. Obviously this may be a daunting task, particularly because of the distance of the ejection. In addition, target shooting is usually done on firing ranges in which a number of shooters are positioned adjacent to one another. The brass can become commingled resulting in arguments as to who owns the brass. In addition, the ejection of the brass can, in some cases, present a hazard on the target range because of the force of the ejected brass.

U.S. Pat. Nos. 4,028,838, 4,110,727, 2,354,277 and 4,959,918 all relate to spent cartridge collection apparatus which are adapted to be connected directly to a long gun such a rifle or a shotgun. Thus none of the collection apparatus shown in those patents are free-standing. U.S. Pat. No. 4,296,565 issued to Jaffin, et. al. show a free-standing apparatus for collecting ejected cartridges. The Jaffin apparatus is in the form of a frame mounted on a pole with a netting received about the frame. The Jaffin apparatus does not appear to be conveniently transportable nor does the Jaffin apparatus segregate one size of brass from another.

OBJECTS OF THE INVENTION

It is one object of this invention to provide an improved cartridge brass collection apparatus.

It is another object to provide a cartridge brass collection apparatus which is portable.

It is another object to provide a cartridge brass collection apparatus which will segregate certain sizes of cartridges from one another.

SUMMARY OF THE INVENTION

In accordance with one form of this invention there is provided a free-standing cartridge brass collector including a container having at least two side walls, a rear wall, a top wall and an open end. Each side wall includes a free edge opposite from the rear wall. A first portion of the top wall contacts the side walls. A second portion of the top wall forms an overhang at the open end. The space below the overhang provides a firing zone for a brass ejecting weapon. The top wall guides the brass into the container.

Preferably a baffle is provided on the inside of the container for segregating certain sizes of brass from one another. It is also preferred that the apparatus include a bottom wall. Preferably the baffle is at an angle with respect to the bottom wall of less than 90 degrees and an opening is formed between the top of the baffle and the top wall so that the brass will pass through the opening into a section located between the baffle and the rear wall.

It is also preferred that the collector is collapsible so as to form a briefcase-like structure, so that the collector is portable. It is preferred that the collapsibility is accomplished through the use of various hinge constructions on the side walls, rear wall and top wall.

BRIEF DESCRIPTION OF THE DRAWINGS

The subject matter which is regarded as the invention is set forth in the appended claims. The invention itself, however, together with further objects and advantages thereof may be better understood reference to the accompanying drawings in which:

DESCRIPTION OF THE PREFERRED EMBODIMENT

Figure 1:
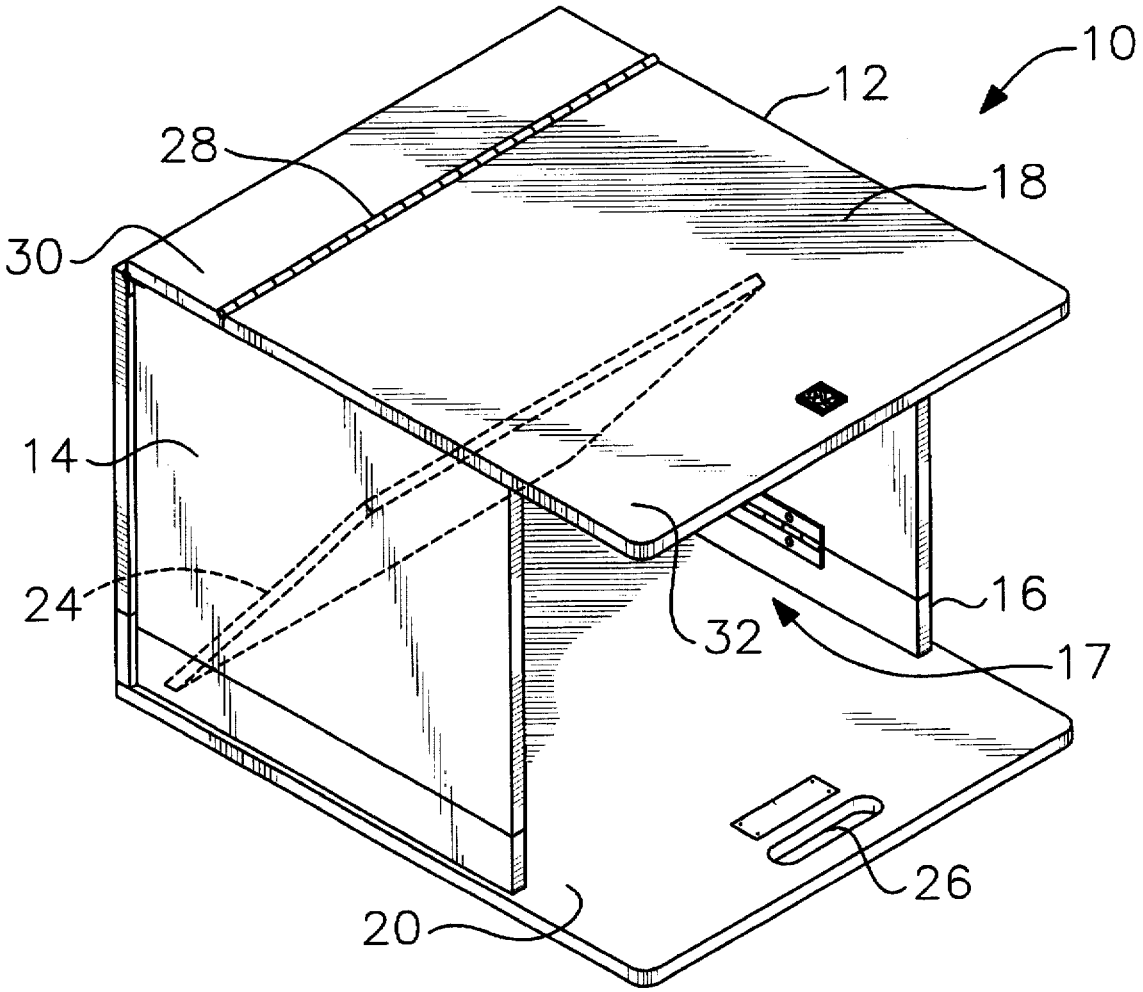
FIG. 1 is a pictorial view of the apparatus of the subject invention.
Figure 2:
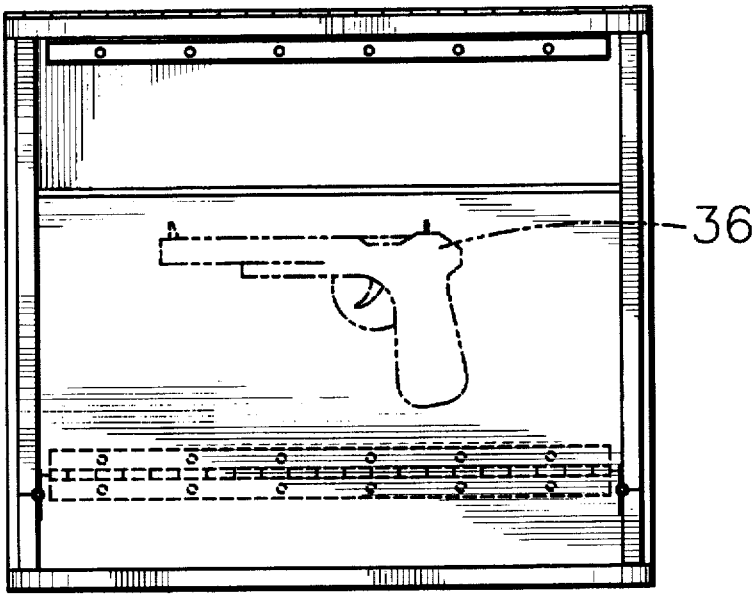
FIG. 2 is a front-elevational view of the apparatus of FIG. 1 and showing a pistol received in the firing zone.
Figure 4:
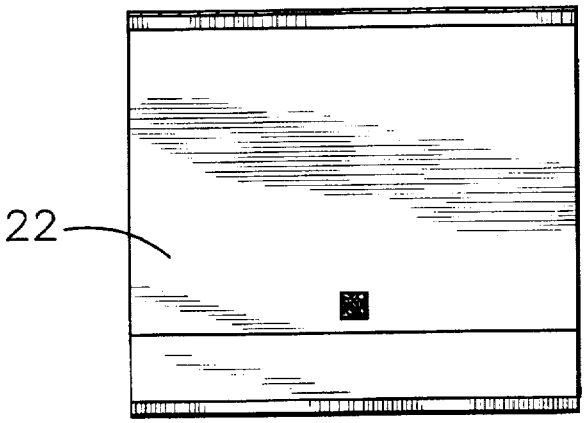
FIG. 4 is a rear-elevational view of apparatus of FIG. 1.

Referring now more particularly to FIG. 1 there is provided portable cartridge brass collector apparatus 10, including container 12, having side walls 14 and 16, top wall 18, bottom wall 20 and, as better seen in FIG. 4, rear wall 22. The collector further includes baffle 24, which is shown in phantom in FIG. 1.

Figure 3:
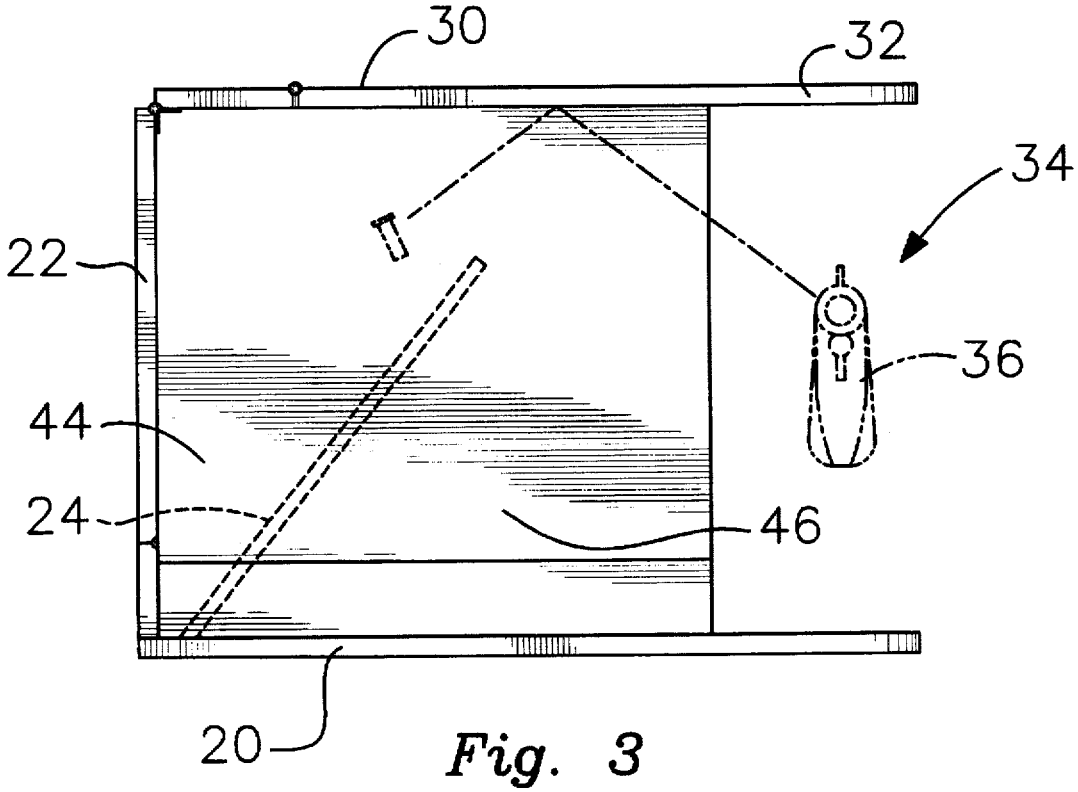
FIG. 3 is a side-elevational view of the apparatus shown in FIG. 2.
Figure 7:
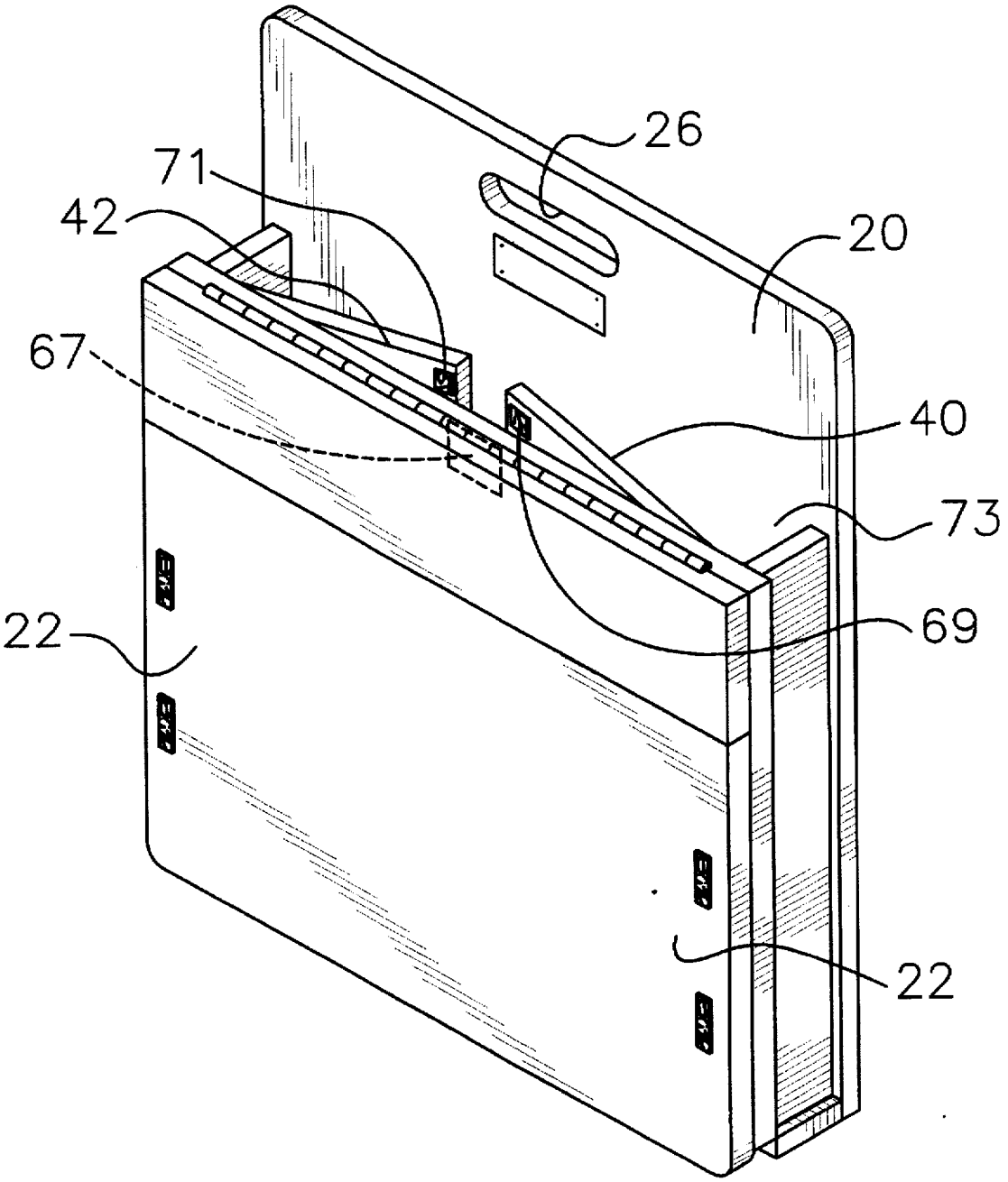
FIG. 7 is a pictorial view of the apparatus of FIG. 1 however with the apparatus fully collapsed to form a briefcase-like structure for portability.

Handle 26, which is in the form of an opening in the top portion of rear wall 20, is provided to enable the collector to be portable when collapsed into a briefcase-like structure, as better shown in FIG. 7. Referring again to FIG. 1, the top wall includes hinge 28. Rear portion 30 of top wall 18 contacts the side walls. Overhang portion 32 of top wall 18 does not contact the side walls. Overhang portion 32 defines a firing zone 34, as best seen in FIG. 3. That is, the shooter places pistol 36 within firing zone 34 pointing the barrel of the pistol 36 in the direction as shown in FIGS. 3 and 4. The ejected brass of some target pistols, such as, for example, 45 caliber eject upwardly and to the right, as shown in FIG. 3, so that the brass will strike the top 30 and bounce off of the top and land inside of the container.

Baffle 24 is received inside of the container at an angle less than 90° with respect to the front portion of bottom wall 20. The lower portion of the baffle makes contact with the bottom wall 20. The baffle is slidably received within a pair of grooves 38 and 39 in the upper portions 40 and 42 of side walls 14 and 16. The baffle defines two separate spaces or sections within container 12, namely section 44, which is located between the baffle and rear wall 22, and section 46, which is located between the baffle and the open end 17 of the container.

By defining two sections within the container, one may readily segregate cartridges which tend to eject in a more vertical direction, such as a 45 caliber which will be collection the section 44, as shown in FIG. 3, from cartridges which eject more horizontally, such as 22 caliber and 32 caliber, which will be collected in section 46. This feature avoids the time consuming problem of segregating the brass by hand. It is preferred that the collector is placed on a flat shooting table and that the shooter place a small block of wood or a book under the bottom 20 near handle 26 so that the collector is slightly canted. This will help guide the brass into the container especially brass which ejects vertically. The collector may also be mounted on a stand (not shown) such as a tripod.

Figure 6:
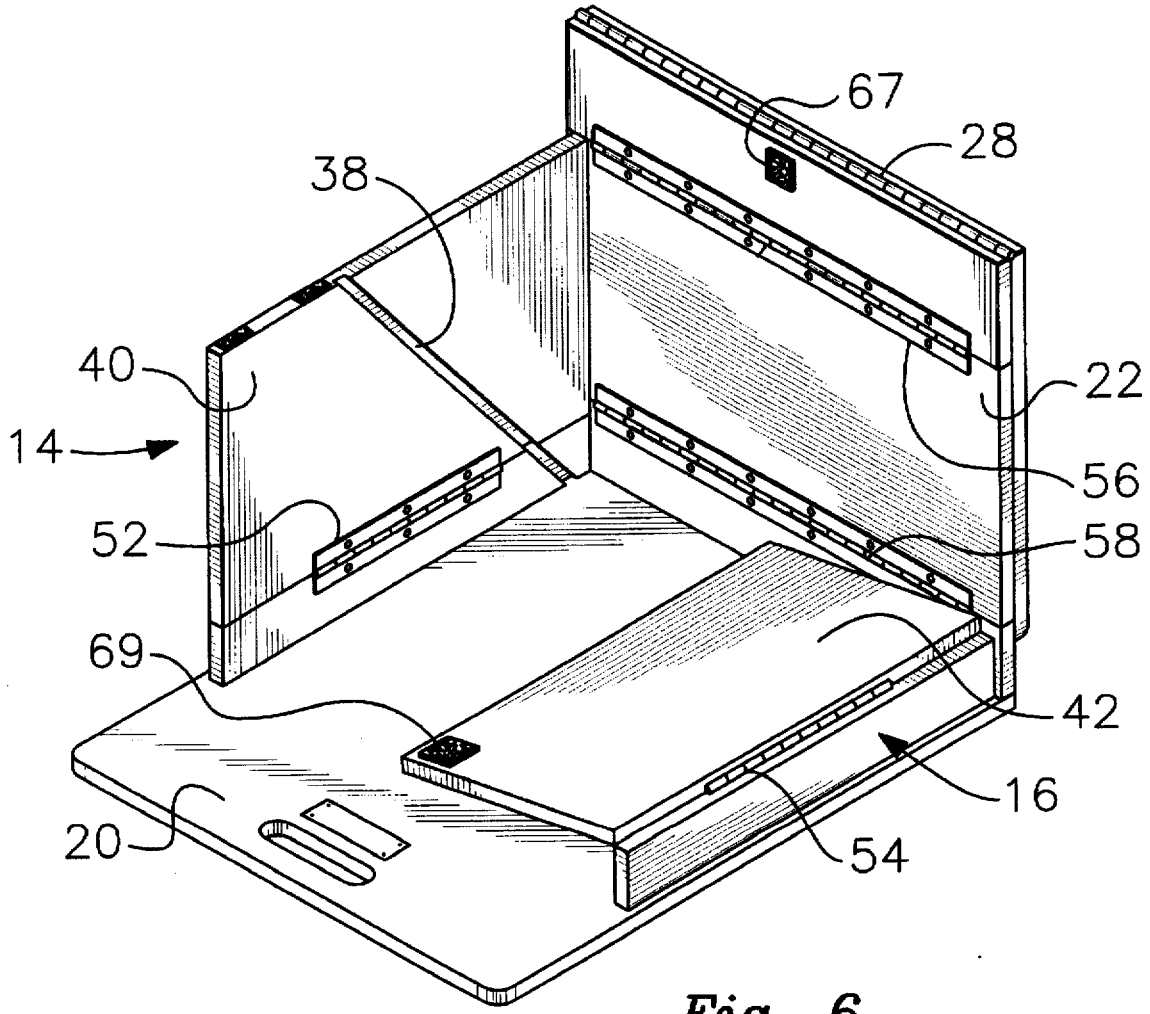
FIG. 6 is a pictorial view of the apparatus of FIG. 1 however with the baffle having been removed and the apparatus being partially collapsed and with one of the side walls having been folded inwardly and with a portion of the top wall having been folded upwardly and another portion of the top wall having been folded rearwardly.

The collector of FIG. 1 may be readily collapsed into a briefcase-like portable apparatus, as shown in FIG. 6. Prior to collapsing the container, however, the baffle 24 must be removed from slots 38 and 39. This collapsing feature is accomplished by the use of various hinges, as described below.

Figure 5:
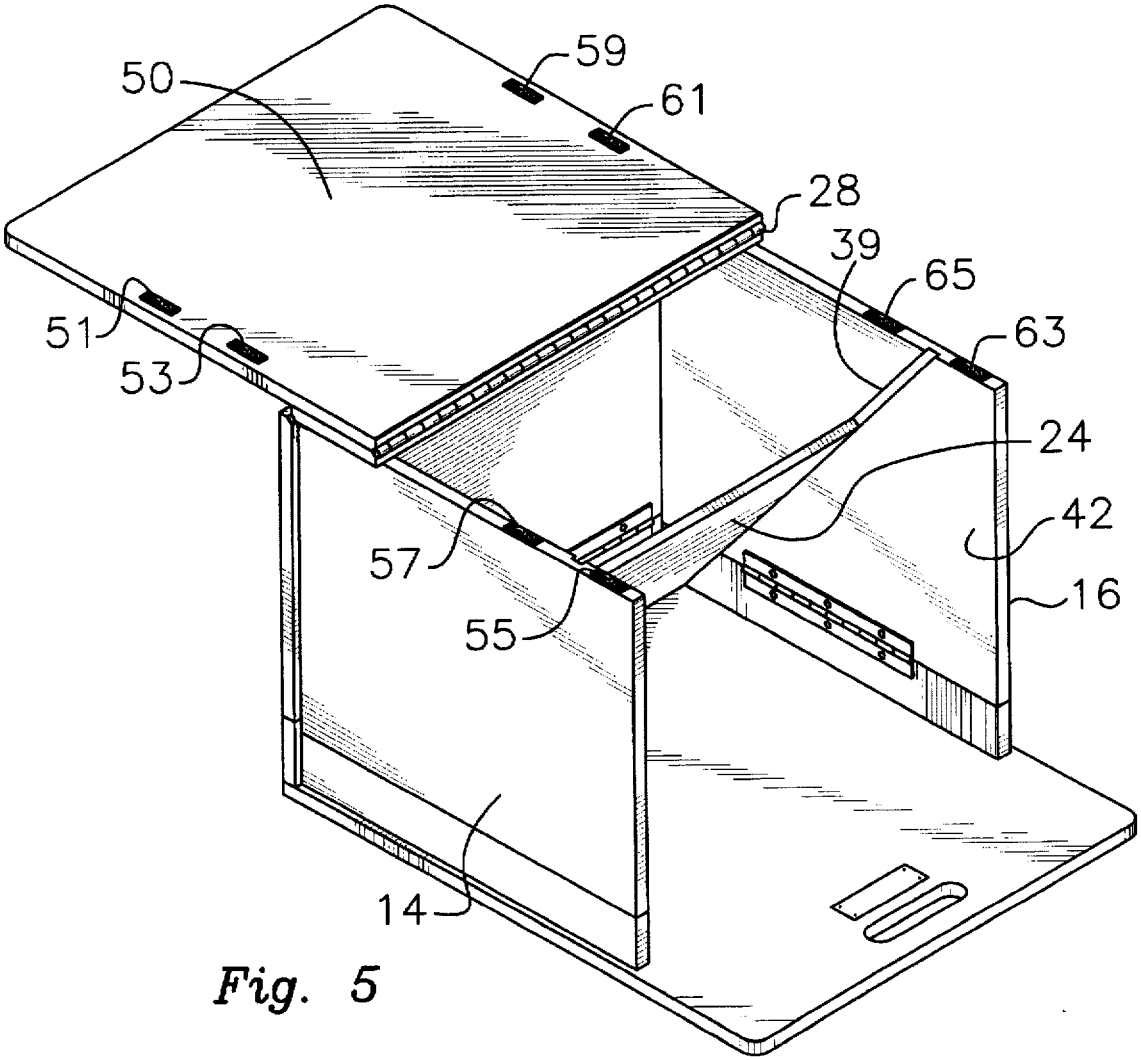
FIG. 5 is a pictorial view of the apparatus shown in FIG. 1 however with a portion of the top wall having been folded back.

As best seen in FIG. 5, hinge 28 enables portion 50 of the top wall 18 to collapse rearwardly. As best shown in FIG. 6, hinge 52 on side wall 14 and hinge 54 on side wall 16 enable the top portions 32 and 34 of those sidewalls to collapse inwardly and make contact with bottom wall 20. Hinges 56 and 58 on rear wall 22 enable the upper portions of the rear wall to collapse forwardly covering the collapsed portions 40 and 42 of the side walls so as to form the briefcase-like structure shown in FIG. 7.

Referring now to FIG. 5, Velcro fasteners 51 and 53 on top portion 50 mate respectively with Velcro fasteners 55 and 57 on the top edge of side wall 14. Likewise, Velcro fasteners 59 and 61 respectfully mate with Velcro fasteners 63 and 65 on the top edge of wall 16 to help stabilize the collector. When the collector has been collapsed into the briefcase-like structure, shown in FIG. 7, Velcro fastener 67, shown in phantom, on top 22 will mate with Velcro fastener 69 located on the collapsed top side portion 42 of side wall 16 and an identical Velcro fastener 71 located on the collapsed portion 40, also shown in FIG. 7.

In order to complete the briefcase-like structure, one must pull the collapsed side portions 40 and 42 towards the wall 22 to make the connection between the Velcro fastener 67 and fastener 69 and 71.

Thus there is provided a stand-alone, cartridge brass collector which avoids the problem of shooters having to retrieve brass. In addition, the collector is readily portable, convenient to use, and has an appealing appearance. The baffle 24, having been removed from slots 38 and 39, may be placed within space 73, shown in FIG. 7.

In addition, the collector enables one to readily segregate various sizes of brass for ease of collection.

From the foregoing description of the preferred embodiment of the invention, it will be apparent that many modifications may be made therein. It will be understood, however, that this embodiment of the invention is an exemplification of the invention only and that the invention is not limited thereto. It is to be understood therefore that it is intended in the appended claims to cover all modifications as fall within the true spirit and scope of the invention.

I claim:

1. A free-standing cartridge brass collector comprising:

a container having at least two side walls, a rear wall, a top wall and an open end;

each side wall having a free edge opposite from said rear wall;

a first portion of said top wall contacting said side wall;

a second portion of said top wall not contacting said side wall;

said second portion of said top wall forming an overhang at said open end and extending beyond said free edges of said sidewalls;

the space below said overhang providing a firing zone for a weapon which ejects brass;

said top wall guiding the brass, which is ejected by the weapon, into said container;

a baffle contacting said side walls for segregating various sizes of brass within said container.

2. A collector set forth in claim 1, wherein said baffle is a planar member;

a bottom wall;

said baffle extending substantially to said bottom wall.

3. A collector set forth in claim 2, wherein said baffle is positioned at an angle with respect to said bottom wall of less than 90° when viewed from said open end.

4. A collector set forth in claim 2, wherein said baffle includes a top edge; an opening between said top edge of said baffle and said top wall whereby certain sized brass will pass through said opening and become trapped inside said container.

5. A collector set forth in claim 4, wherein said baffle includes side edges; a groove in each sidewall for slidable receiving said side edges of said baffle.

6. A collector as set forth in claim 2, wherein said bottom wall includes a handle to enhance portability.

7. A collector as set forth in claim 1, when said baffle defines first and second sections inside of said container;

said fist section being between said baffle and said rear wall;

said second section being between said baffle and said open end.

8. A free-standing cartridge brass collector comprising:

a container having at least two side walls, a rear wall, a top wall and an open end;

each side wall having a free edge opposite from said rear wall;

a first portion said top wall contacting said side wall;

a second portion of said top wall not contacting said sidewall;

said second portion of said top wall forming an overhang at said open end and extending beyond said free edges of said sidewalls;

the space below said overhang providing a firing zone for a weapon which ejects brass;

said top wall guiding the brass, which is ejected by the weapon, into said container;

said collector is collapsible wherein said collector is readily portable;

each of said sidewalls includes a hinge so that at least a top edge portion of each of said sidewalls when collapsed inwardly contacts said bottom wall.

9. A collector as set forth in claim 8, wherein said rear wall includes at least one hinge so that at least a portion of said rear wall may be collapsed inwardly to cover said collapsed portion of each of said sidewalls.

10. A collector as set forth in claim 9, wherein said top wall includes a hinge.

* * * * *